US012024897B2

(12) United States Patent
Miller et al.

(10) Patent No.: US 12,024,897 B2
(45) Date of Patent: Jul. 2, 2024

(54) QUAD SPACER FOR INSTALLATION OF FLOORING SYSTEMS

(71) Applicant: Q.E.P. Co. Inc., Boca Raton, FL (US)

(72) Inventors: Bradley Scott Miller, Boca Raton, FL (US); Joseph Deguglimo, Boca Raton, FL (US)

(73) Assignee: Q.E.P, Co. Inc., Boca Raton, FL (US)

( * ) Notice: Subject to any disclaimer, the term of this patent is extended or adjusted under 35 U.S.C. 154(b) by 0 days.

(21) Appl. No.: 17/693,475

(22) Filed: Mar. 14, 2022

(65) Prior Publication Data

US 2022/0220745 A1 Jul. 14, 2022

Related U.S. Application Data

(63) Continuation-in-part of application No. 16/967,766, filed as application No. PCT/US2019/056860 on Oct. 18, 2019, now abandoned.

(60) Provisional application No. 62/749,365, filed on Oct. 23, 2018.

(51) Int. Cl.
*E04F 15/02* (2006.01)
*E04F 21/00* (2006.01)

(52) U.S. Cl.
CPC .... *E04F 15/02027* (2013.01); *E04F 21/0092* (2013.01)

(58) Field of Classification Search
CPC . E04F 21/22; E04F 15/02005; E04F 21/0092; E04F 15/02027
See application file for complete search history.

(56) References Cited

U.S. PATENT DOCUMENTS

| | | | | |
|---|---|---|---|---|
| 2,930,135 | A * | 3/1960 | Rodtz, Sr. | E04F 21/0092 52/603 |
| 4,899,455 | A * | 2/1990 | Bovino | E04F 21/22 33/527 |
| 4,908,952 | A * | 3/1990 | Joos | E04F 13/14 33/526 |
| 5,657,598 | A | 8/1997 | Wilbs | |
| 10,883,285 | B1 * | 1/2021 | Zherlo | E04F 21/0092 |
| 11,473,316 | B2 * | 10/2022 | Preston | E04F 21/0092 |
| 2005/0214502 | A1 * | 9/2005 | Westthorp | E04F 13/08 428/98 |
| 2006/0101780 | A1 * | 5/2006 | Duterte | E04F 21/0092 52/749.1 |
| 2006/0144011 | A1 * | 7/2006 | Symington | E04F 21/1838 52/782.1 |

(Continued)

FOREIGN PATENT DOCUMENTS

| | | | | |
|---|---|---|---|---|
| CA | 2773862 | A1 * | 10/2013 | E04F 21/22 |
| GB | 2422158 | A * | 7/2006 | E04F 15/02005 |

(Continued)

OTHER PUBLICATIONS

ISR for PCT/US2019/056860 (Feb. 5, 2020).
ISA Written Opinion for PCT/US2019/056860 (Feb. 5, 2020)J.

*Primary Examiner* — Babajide A Demuren
(74) *Attorney, Agent, or Firm* — SCHNEIDER IP LAW; Jerold I. Schneider

(57) ABSTRACT

A spacer (10) for creating a properly dimensioned gap during the installation of a flooring system, the spacer providing four non-adjustable portions to be selectively placed on a subfloor, each non-adjustable portion having a different width corresponding to an intended gap width.

18 Claims, 7 Drawing Sheets

(56) References Cited

U.S. PATENT DOCUMENTS

| | | | | |
|---|---|---|---|---|
| 2015/0197946 | A1* | 7/2015 | Tooma | E04F 21/0092 33/527 |
| 2016/0032598 | A1* | 2/2016 | Anderson | E04F 21/0092 206/349 |
| 2016/0244975 | A1* | 8/2016 | Jones | E04F 21/0092 |

FOREIGN PATENT DOCUMENTS

| | | |
|---|---|---|
| IT | VR20 090 133 | 3/2011 |
| WO | WO 02/06609 | 1/2002 |

* cited by examiner

QUAD SPACER FOR INSTALLATION OF FLOORING SYSTEMS

BACKGROUND

A flooring system comprises a series of interlocking panels installed above and in contact with a subfloor. The panels may be formed of natural wood, engineered flooring, laminate flooring or vinyl, vinyl tile, wood plastic composite, stone polymer composite, etc.

It is desirable to provide a horizontal gap or space or "offset" between the edge of the panel and an adjacent vertical wall. The space or "offset" from the wall accommodates expansion and shrinkage of the flooring normally attributable to factors such as changes in ambient temperature and humidity. In addition, when installing flooring, the vertical walls (typically drywall) do not always extend down to the level of the subfloor. There is frequently a vertical gap of one inch (2.54 cm) or more from the subfloor level to the bottom of the vertical drywall. Most of the flooring to be installed does not have a height (thickness) above the subfloor sufficient to cover this gap. The gap or space is normally covered by moulding for aesthetic purposes.

In addition, when installing a flooring above a subfloor where there is an opening, such as for a doorway into a closet or an adjacent room, or even for a doorway between the interior and exterior of a house, it is desirable to provide a horizontal gap or space between the edge of the flooring panels to accommodate expansion. The gap or space is subsequently covered by a threshold rather than covered by a moulding for aesthetic purposes.

When installing the flooring, each successive panel (wooden or laminate planks or strips, etc.,) is forced against the previously positioned panel to make the flooring joints secure. This results in pushing the flooring under the vertical gap between the bottom of the drywall and the subfloor. This creates a problem during installation of the floor and creates a problem in not accommodating normal expansion of the flooring after the installation has been completed.

In the past, installers would utilize wedges or shims placed vertically between the wall and the floor. However, any movement of the flooring toward the wall, such as when successive flooring members are pushed up against already-installed flooring members frequently forced the bottom of the wedges into the vertical space or gap at which point the wedges could rotate or pivot out of position and no longer be useful. Furthermore, since there was no standard in the construction industry for the size of the vertical gap and/or for any desired horizontal gap between the vertical wall and the flooring, while installers frequently had to use multiple wedges as spacers to accommodate a horizontal gap, there was no spacer to accommodate the larger vertical gap.

U.S. Pat. No. 8,881,418 (Funk) illustrates a spacer to provide a fixed horizontal gap between the edge of the flooring panels and an adjacent vertical wall. PCT Application No. PCT/US2019/056860 illustrates and describes a T-shaped spacer that provides three different spacings. Publication WO 02/06609 discloses a spacer for laying flooring. U.S. Patent Publication 2016/0244975 discloses a spacer assembly. U.S. Pat. No. 5,657,598 discloses a joint-making device.

SUMMARY

The present description relates to spacers that provide four alternate non-adjustable dimensions so that the installer may select the appropriately-dimensioned spacer without the need to maintain an excessive inventory, i.e., without the need to maintain four different inventories. The spacer may be used to provide spacing between the edge of the flooring and an associated wall and may be used to provide a suitable space between the flooring being installed and an adjacent flooring for a doorway or the like to accommodate a threshold device.

Significantly, the quad or four-dimensioned spacer is adapted for removal after use so that the spacer may be reused in subsequent installations.

In one embodiment, the present description relates to a spacer for creating a properly dimensioned gap during the installation of a flooring system, the spacer including three top surfaces each a different distance from the spacer bottom, each distance corresponding to a different intended floor spacing gaps.

In another embodiment the spacer for creating a properly dimensioned gap during the installation of a flooring system, includes three top surfaces each a different distance from the spacer bottom, each distance corresponding to a different intended floor spacing gap, and a width having a dimension different from the three different distances between the top surfaces and the bottom, to provide four different floor spacing gaps.

In yet another embodiment, the present description relates to a spacer for creating a properly dimensioned gap during the installation of a flooring system, including a first element extending in a first direction and joined to a projection element, the first direction and the projection element being generally perpendicular to each other, the first element having four different widths and/or thicknesses corresponding to four potential intended expansion gaps.

In any of the preceding embodiments, the expansion gaps may be approximately 0.636 cm, 0.953 cm, 1.27 cm and 2.54 cm, (0.25, 0.375, 0.5 and 1.0 inch) and in any of the embodiments the spacer may be moulded of a rigid suitable thermoplastic and may be moulded as a single, unitary body.

In any of the preceding embodiments, the spacer may be removable and reusable.

Yet another embodiment of the present invention is a method for installation of a flooring system according to any one or more of the preceding embodiments further including positioning the spacer on a subfloor adjacent a vertical surface to provide the desired expansion gap and positioning the flooring system to abut the spacer.

Yet another embodiment of the present invention is a method for installation of a flooring system according to any one or more of the preceding embodiments further including positioning the spacer on a subfloor adjacent a vertical edge of another horizontal surface to provide the desired expansion gap and positioning the flooring system to abut the spacer.

BRIEF DESCRIPTION OF THE DRAWINGS

The following drawings illustrate one form of the spacer and its use. The drawings are to be interpreted in a broad, non-limiting sense and as being exemplary. In the drawings, wherein like reference numerals identify corresponding components.

DETAILED DESCRIPTION

Figure 1:
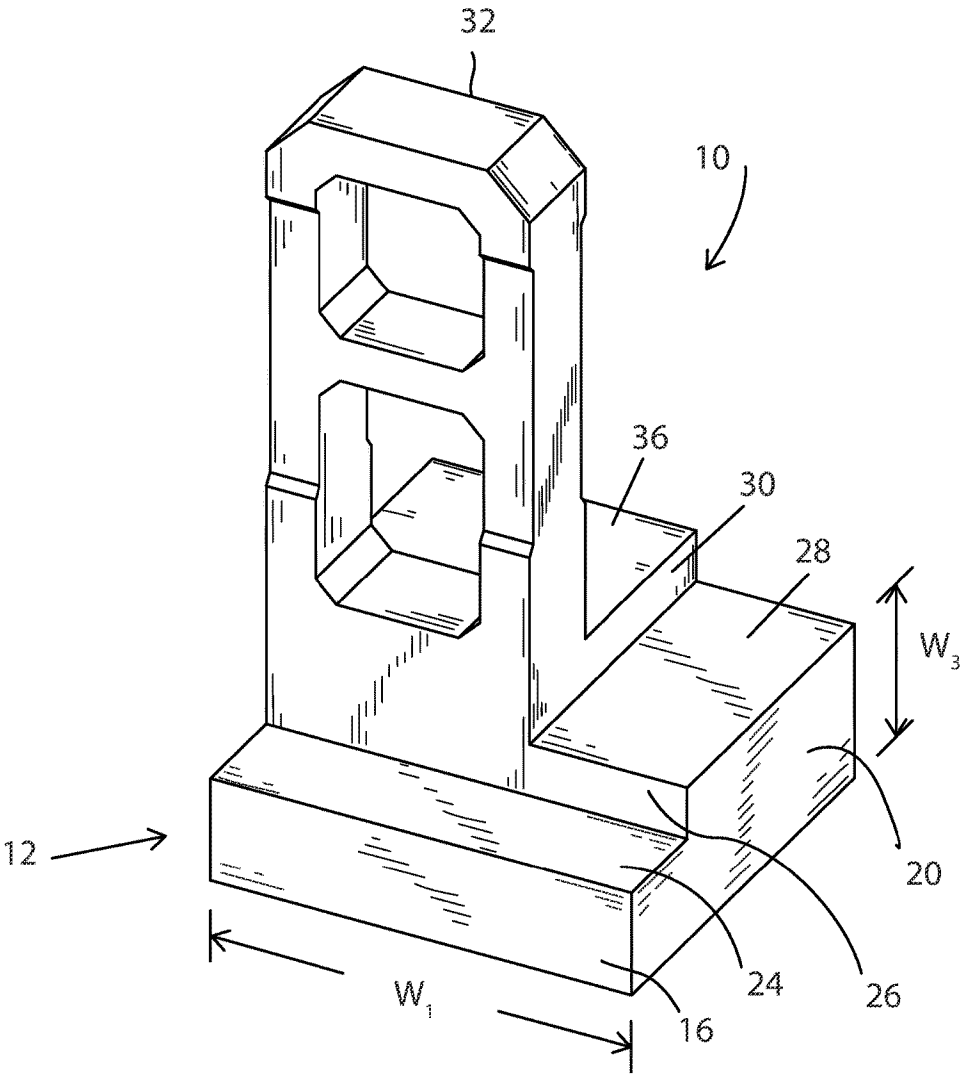
FIG. 1 is a perspective view of a quad spacer.

Referring to the drawings, it should be understood that terms such as top, bottom, left, right, first end, second, end, above, below, thin and thick are used as relative terms for explanatory purposes only and are not used in a limiting sense. Similarly, references to materials and shapes are intended solely as illustrative and thus are used in a non-limiting sense.

A spacer 10 may be formed as a unitary product or in multiple parts subsequently attached together. The spacer may be formed of one or more materials including but not limited to metal, plastic, rubber, and/or wood, and may be moulded of a rigid suitable thermoplastic material. The spacer has a generally rectangular base 12 having a bottom 14, opposed first and second sides 16, 18, and opposed first and second ends 20, 22. For ease of explanation and not in a limiting sense, the distance between the first and second ends 20, 22, will be referred to as the width and the distance between the first and second sides 16, 18, will be referred to as the thickness.

The spacer 10 has a top with three different surfaces, each a different distance from the bottom of the spacer. The top with thus be referred to as a three-part top, each part being generally flat and generally parallel to the bottom 14. The first top part 24 extends across the entire width of the spacer, i.e., between the ends 20, 22 and extends approximately 20% of the thickness of the spacer starting at the first side 16 toward the second side 18. The first top part 24 terminates at a vertical wall 26 extending upwardly across the entire width of the spacer from end 20 to end 22. A projection extends upwardly from the vertical wall 26 and will be explained in greater detail below.

The second top part 28 extends from the vertical wall 26 across the width to the remainder of the thickness of the spacer to the second side 18. The second top part 28 is generally parallel to the bottom 14 and generally parallel to the first top part 24. The height of the spacer is greater between the second top part 28 and the bottom 14 than the height of the spacer between the first top part 24 and the bottom 14, i.e., the top part 28 of the spacer is above the top part 24 of the spacer relative to the spacer bottom 14.

The second top part 28 extends from the end 20 approximately 40% of the width of the spacer and terminates in an upwardly extending vertical wall 30.

A projection 32 extends upwardly from the top of the spacer. The projection has a width approximately 60% of the width of the spacer starting from the end 22 and extending toward the end 20. Thus, one edge of the projection is in the same plane as the end 22. The projection has a thickness of approximately 20% of the thickness of the spacer and includes one or more apertures 34 through the thickness. The height of the projection is preferably greater than the width or thickness of the spacer. Thus, the spacer 10 is generally L-shaped with the projection forming the longer leg of the L. The front of the projection is in the same vertical plane as the plane of the vertical wall 26.

The third top part 36 extends from the rear of the projection 32 to the second end 18 (length) and from the top of the vertical wall 30 to the end 22 which is approximately 60% of the width of the spacer. The height of the spacer is greater between the third top part 36 and the bottom 14 than the height of the spacer between the second top part 28 and the bottom 14, i.e., the top part 36 of the spacer is above the top part 28 of the spacer relative to the spacer bottom 14.

Figure 2:
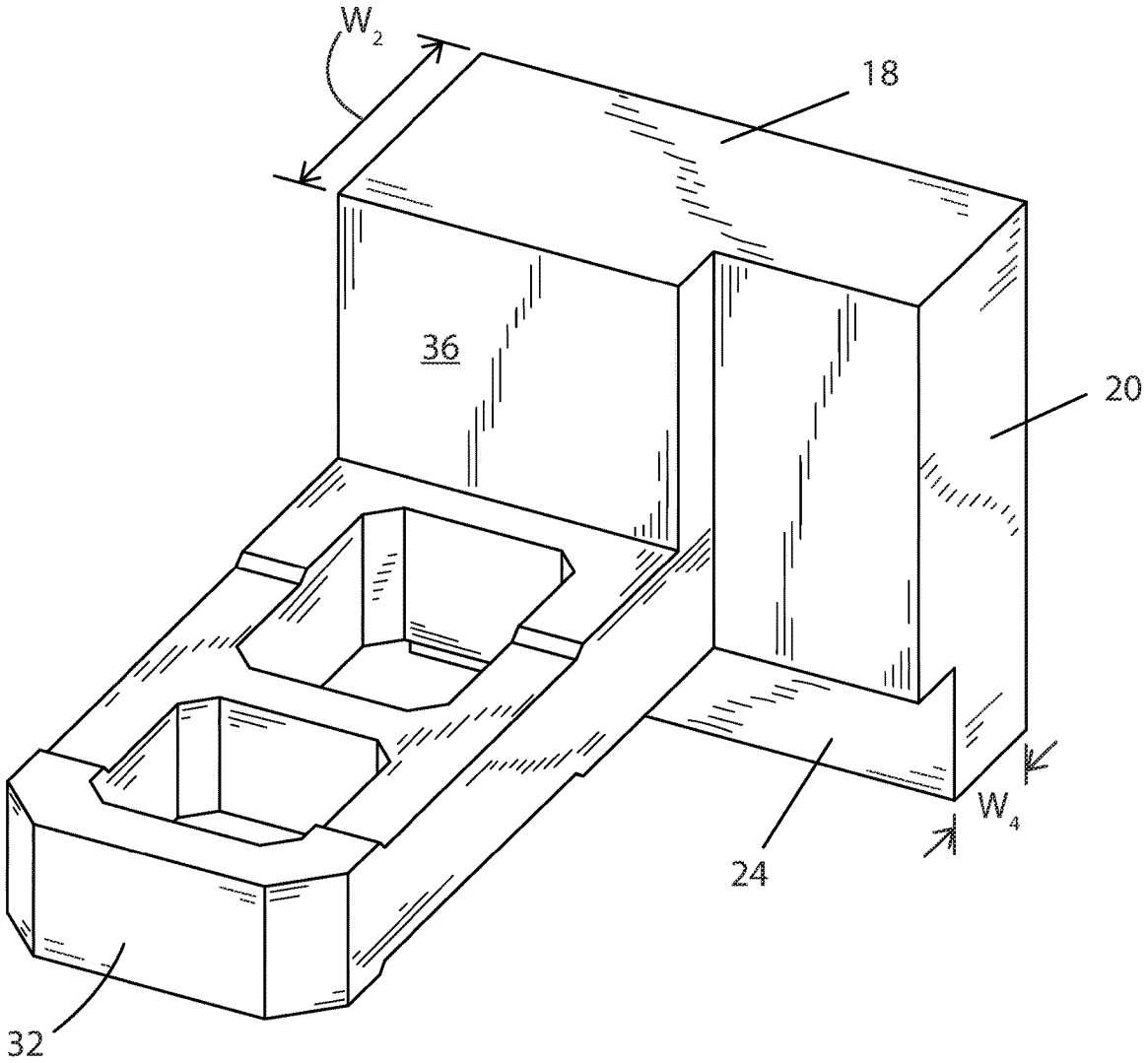
FIG. 2 is a second perspective view of a quad spacer.
Figure 3:
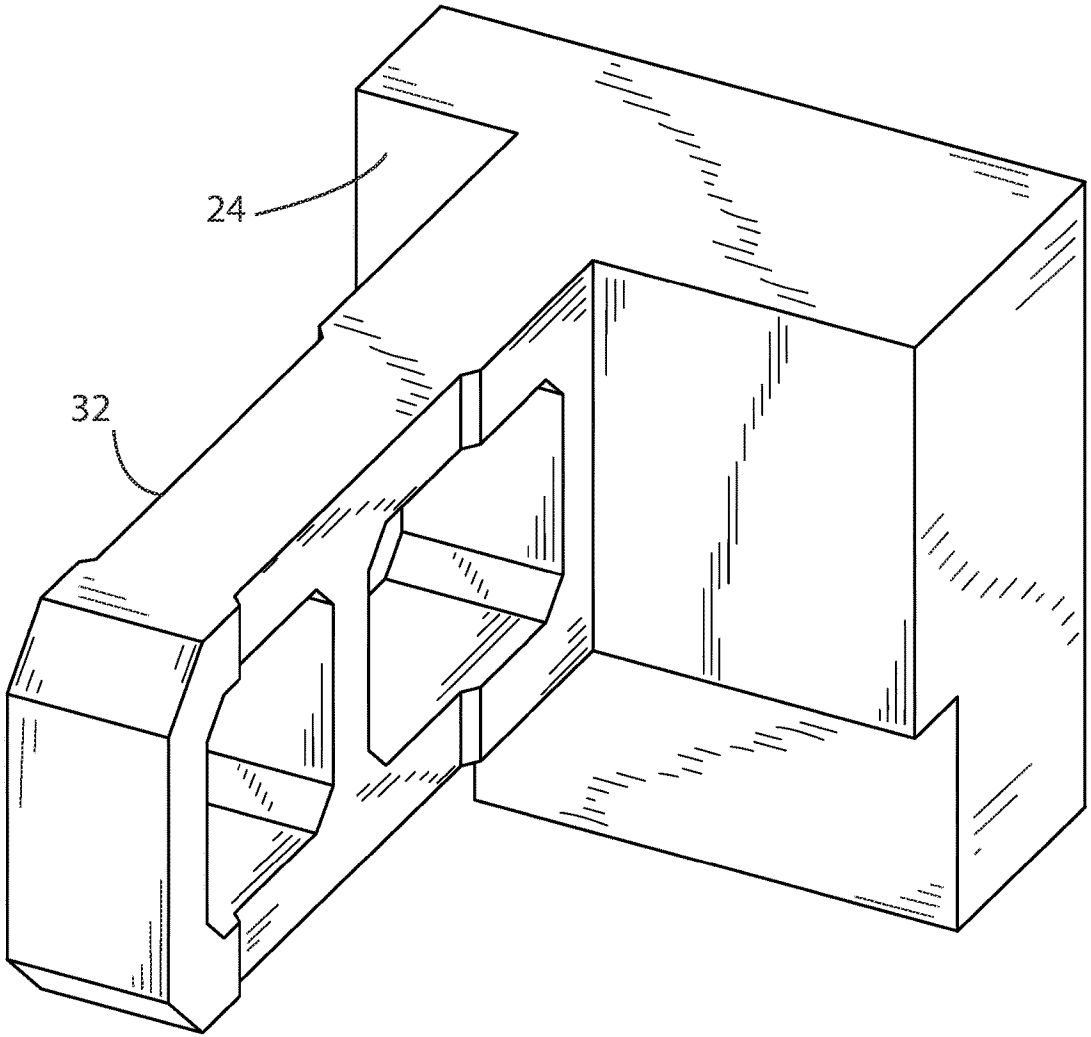
FIG. 3 is a third perspective view of a quad spacer.
Figure 4:
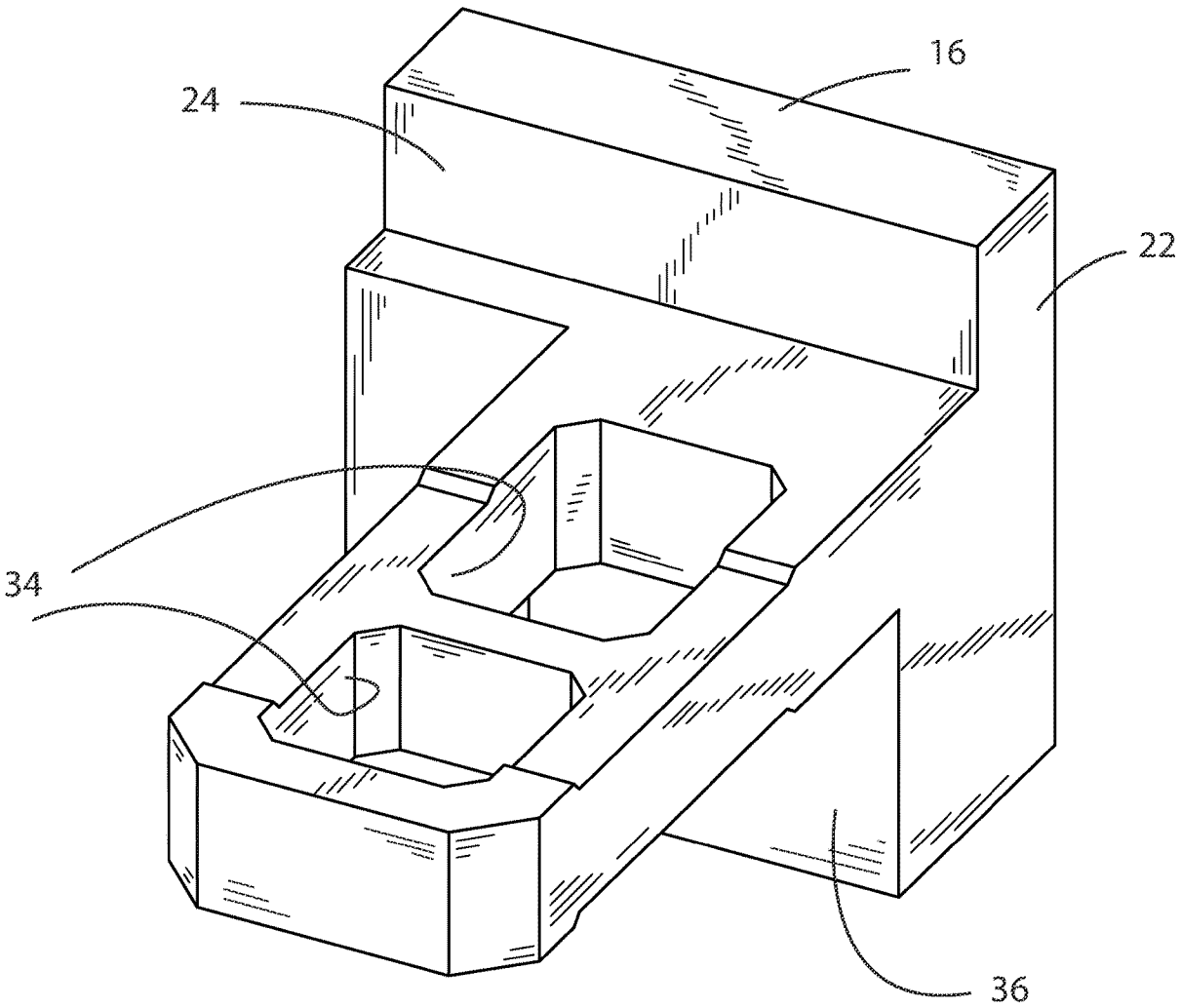
FIG. 4 is a fourth perspective view of a quad spacer.

The relative non-adjustable dimensions of the spacer, in a non-limiting example, will now be explained. A first width $W_1$ is illustrated in FIG. 1 as the distance between the first and second ends 20, 22 and is preferably 2.54 cm (1.0 inch). A second width $W_2$ is illustrated in FIG. 2 as the distance between the third top part 36 and the bottom 14 and is preferably 1.27 cm (0.5 inch). A third width $W_3$ is illustrated in FIG. 1 as the distance between the second top part 28 and the bottom 14 and is preferably 0.953 cm (0.375 inch) and a fourth width $W_4$ is illustrated in FIG. 2 as the distance between the first top part 24 and the bottom 14. This fourth width is preferably 0.635 cm (0.25 inch).

Figure 5:
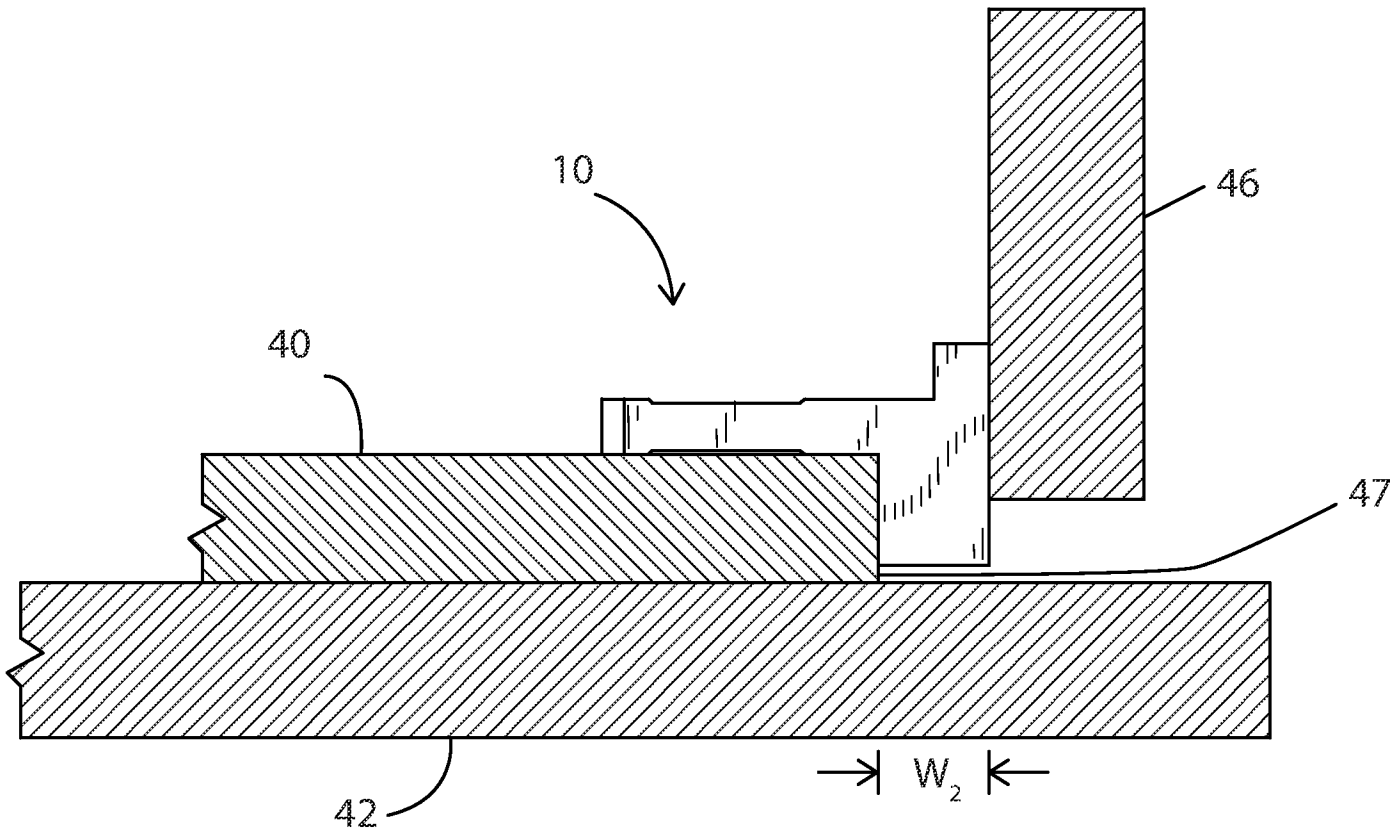
FIG. 5 is a sectional view of a spacer positioned between a generally horizontal surface and a generally vertical surface to illustrate the provision of an expansion gap.
Figure 6:
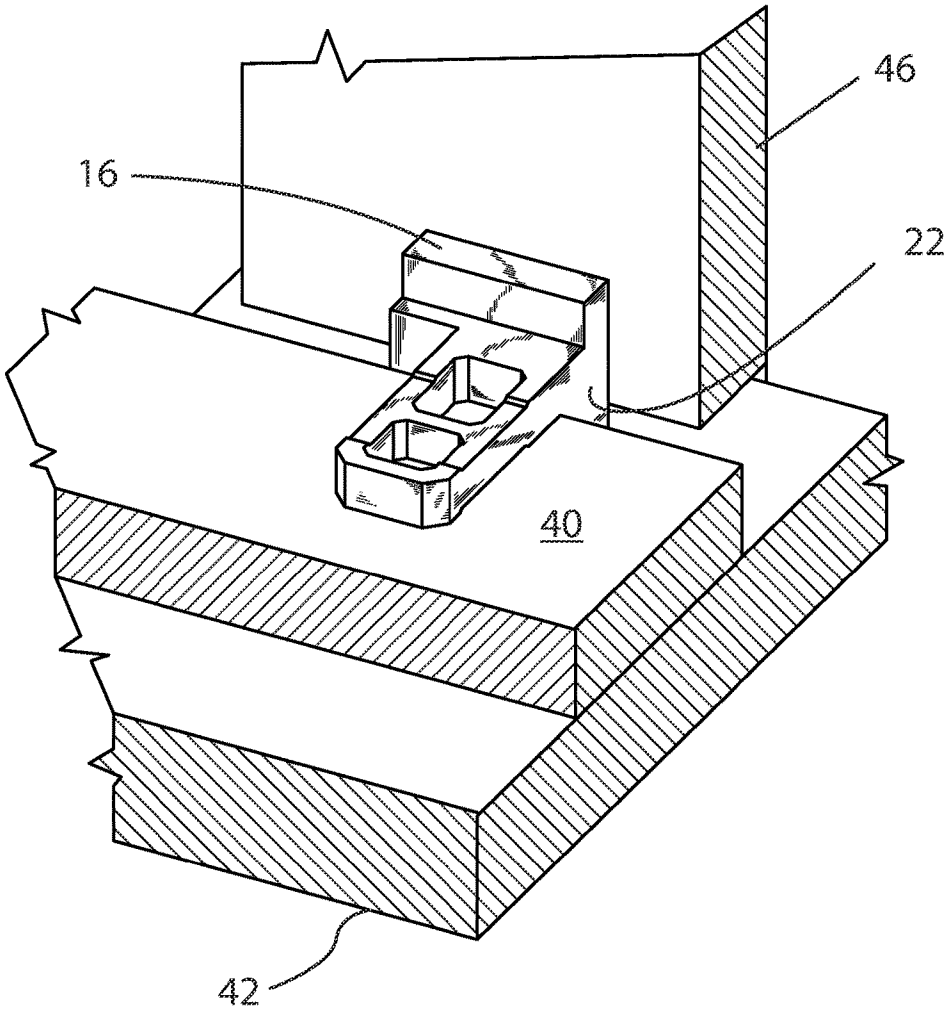
FIG. 6 is a perspective illustration of a spacer positioned between a generally horizontal surface and a generally vertical surface.
Figure 7:
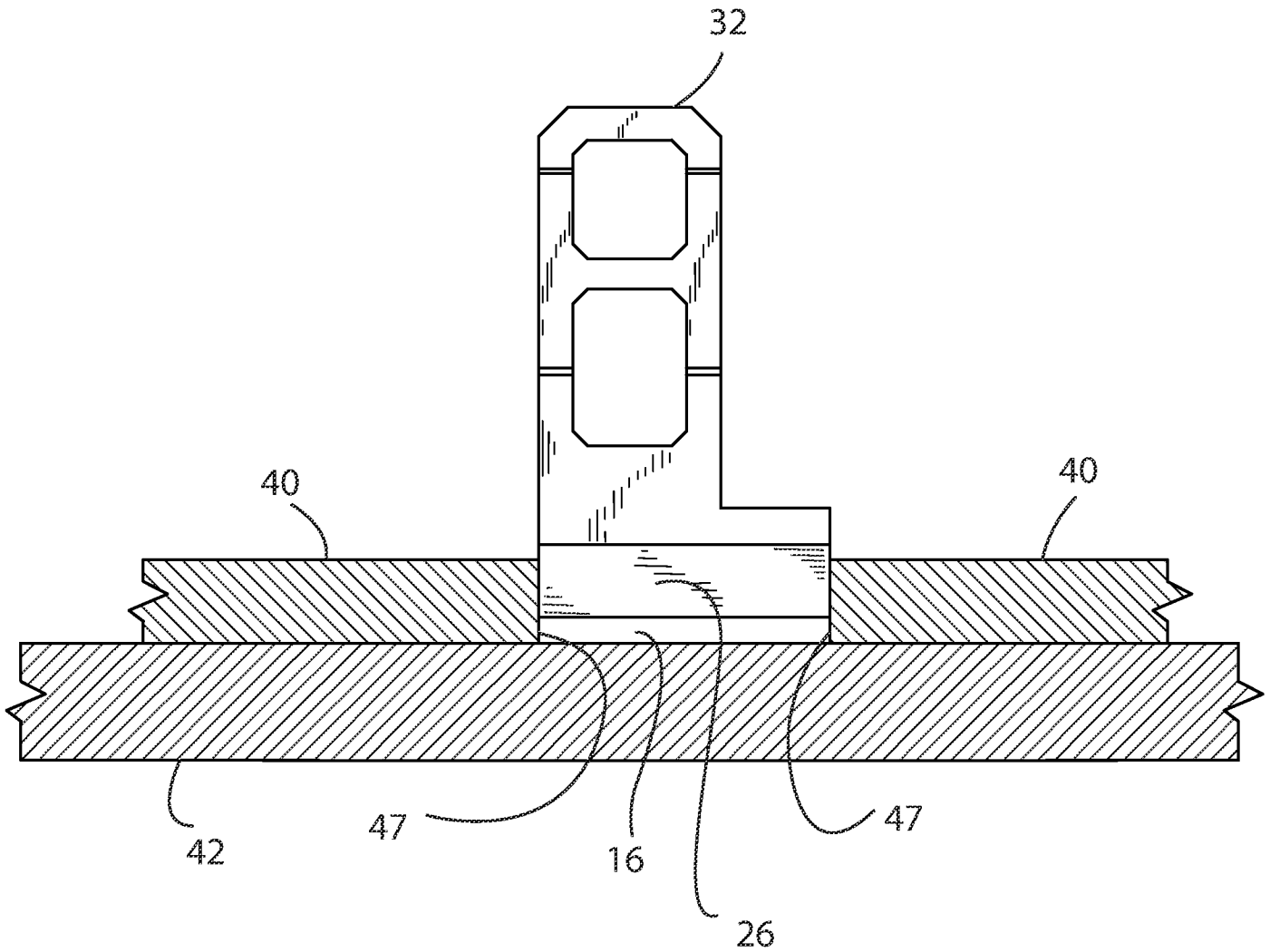
FIG. 7 is a sectional view of a spacer positioned between two generally horizontal surfaces to provide an expansion gap.

Referring next to FIGS. 5, 6 and 7, various uses of the spacer will now be explained. In FIG.5, flooring planks 40 (only a single plank is illustrated) are to be installed above a subfloor 42. The flooring plank has a leading edge 44 and it is necessary to establish a gap or space between the leading edge 44 (of each plank) and the adjacent vertical wall 46. In FIG. 5, the spacer is positioned with the projection 32 on the flooring plank, with the spacer bottom 14 in contact with the vertical wall 46, and with the third top part 36 positioned to be in abutting relationship with the leading plank edge 44 as the planks are installed. In this exemplary arrangement, the gap or space between the leading plank edge and the vertical wall will correspond to width $W_2$. Thus the spacer provides a deliberate gap between a plank lying in a first plane and a wall being in a second plane perpendicular to the first plane.

FIG. 6 is a perspective illustration of the use of the spacer as just described with respect to FIG. 5.

Referring next to FIG. 7, the use of the spacer to provide a gap between two planks that are in the same plane (or parallel planes) will now be described. As explained above, a gap in this situation may be desired when a threshold is to be used between flooring in adjacent rooms or even for a doorway between the interior and exterior of a building.

In FIG. 7 there are two flooring planks 40 being installed on a subfloor 42. The spacer is arranged with the projection 32 extending upwardly, away from the subfloor, and with the opposed ends 20, 22, in position to abut the leading edges 44 of two adjacent planks 40. In this arrangement, a gap is created between the adjacent planks with the gap having a width corresponding to the width of the spacer between ends 20 and 22, which has been previously referred to as width $W_1$.

Although not illustrated, multiple spacers should be positioned along the length of the wall (and thus along the length of the flooring planks) and one or more additional spacer should be positioned at the end of the plank adjacent a wall (not shown) perpendicular to the wall 46, for example as would be typical in the corner of a room in a house. In this non-limiting illustration, an expansion gap is created and maintained between the vertical wall 46 and edge 44 of the flooring planks 40. The positioning of the spacer with the projection 32 on top of the flooring plank 40 aids in maintaining the flooring plank in position during installation and also prevents the spacer 10 from pivoting out of position. The spacer 10 is easily removable after a suitable number of flooring planks 40 have been placed in position such that the spacer 10 may be reused.

If it is desired to have a different expansion gap between the flooring planks and the vertical wall, the spacer 10 should be oriented so that a different width (e.g., $W_3$) is positioned between the plank edge and the vertical wall.

Depending on variations in the positioning of the vertical walls within a room or within a house, the spacer 10 provides the advantage that the expansion gaps need not be the same size, rather, the installer of the flooring system may use different expansion gaps. It should also be appreciated that creating a horizontal expansion gap during installation of the flooring system is not the sole benefit of the spacer 10. As one example, it should be appreciated that there is a vertical gap between the bottom of the vertical wall 44 and the top of the subflooring 50. This gap is normally concealed by moulding at the conclusion of the installation of the flooring system. The use of the spacer 10 prevents the flooring from being unintentionally positioned within the vertical gap. Conduits, including but not limited to electrical, plumbing and/or ventilation conduits may be placed within the vertical gap without interference from the flooring and the conduits will subsequently be concealed by moulding. Thus, the physical height of the spacer is not limited by the thickness of the flooring planks 40.

Although only one spacer 10 is illustrated, it should be appreciated that during the installation of a flooring system, spacers may be positioned at regular intervals along the length of the floor. If, for example the floor is formed of a series of planks 40 of 15.24 cm width and 182.88 cm length, then spacers may be placed every 30.48 cm along the length of a flooring plank and one spacer may be placed at the end of each flooring plank where the flooring plank would otherwise contact the wall.

It should further be appreciated that the spacer 10 provides a reusable apparatus that provides four different size non-adjustable expansion gaps relative to the flooring system.

The foregoing is a complete but non-limiting description of the removable, reusable spacer and the method of its use to provide four different spacing gaps during installation of flooring.

The invention claimed is:

1. A spacer for creating a properly dimensioned gap during the installation of a flooring system, the spacer being a generally rectangular base and having opposed sides, opposed ends, a bottom and a top, the improvement characterized by:

the spacer for creating at least three different sized expansion gaps;

the spacer top comprising first, second and third parts each part being a different height above the bottom of the base and each part extending in the same direction above the bottom of the base;

the distance between each of said first, second and third parts and the bottom of the base thus respectively providing first, second and third projections for three different sized expansion gaps, and the distance between the opposed ends providing a fourth projection and being a different distance when compared to each of the distances between the three parts of the top and the bottom of the base respectively.

2. A spacer for creating one of at least three different sized gaps during the installation of a flooring system, comprising:

a generally rectangular base having first and second opposed sides, first and second opposed ends, a bottom and a top;

the top of the base having an upper surface and a lower surface with a vertical wall therebetween, the upper and lower surfaces being generally parallel to each other and generally parallel to the bottom of the base;

a projection extending upwardly from the base upper surface in a direction opposite to said base lower surface, the projection including a generally flat surface parallel to the upper surface of the base and having a vertical wall between the projection flat surface and the base upper surface;

a first gap width ($W_1$) defined as the distance of the base between two opposed ends;

a second gap width ($W_2$) defined as the distance between the generally flat surface of the projection and the bottom of the base;

a third gap width ($W_3$) defined as the distance between the upper surface of the top of the base and the bottom of the base;

a fourth gap width ($W_4$) defined as the distance between the lower surface of the top of the base and the bottom of the base;

wherein at least two gap widths differ from each other and wherein one of said gap widths extends transverse to at least one of said second, third and fourth gap widths.

3. The spacer according to claim 1 or claim 2 wherein each of the distances is non-adjustable.

4. A method of installing a floor using flooring planks, each flooring plank having a plank edge, comprising placing at least one spacer of any preceding claim on a subfloor in an abutting relationship with the plank edge to provide a gap between the plank edge and an adjacent structure.

5. The method according to claim 4 wherein the gap is provided between a plank edge and an adjacent vertical wall.

6. The method according to claim 4 wherein the gap is provided between the plank edges of adjacent planks.

7. The spacer according to any of the preceding claims, wherein the spacer comprises a single moulded body.

8. The spacer according to any of the preceding claims, wherein the spacer comprises a single moulded body comprised of a rigid suitable thermoplastic.

9. The spacer according to any of the preceding claims, wherein the spacer is removable and reusable.

10. A method of installing a flooring system with an expansion gap having a non-adjustable width, comprising selecting a spacer according to any of the preceding claims, inserting the spacer on a subfloor adjacent to a vertical surface, and placing a flooring plank in an abutting relationship to the spacer.

11. The method according to claim 10 wherein the spacer has four different gap width projections.

12. The spacer according to claim 2 wherein no two gap widths are the same.

13. The spacer according to claim 1 and further including an additional projection extending upwardly relative to the base to facilitate use of the spacer.

14. The spacer according to claim 2 and further including an additional projection extending upwardly relative to the base to facilitate use of the spacer.

15. The method of claim 4 wherein the spacer includes an additional projection extending upwardly relative to the base to facilitate placing said at least one spacer into said abutting relationship.

16. The method of claim 13 wherein said additional projection facilitates removal of said spacer.

17. The method of claim 10 wherein the spacer includes an additional projection extending upwardly relative to the base to facilitate inserting said spacer on said subfloor.

18. The method of claim 17 wherein said additional projection facilitates removal of said spacer.

* * * * *